United States Patent [19]

Robin

[11] 4,395,067

[45] Jul. 26, 1983

[54] LIFTING ASSEMBLY

[75] Inventor: Peter D. L. Robin, Cheshire, England

[73] Assignee: Spanset Inter A.G., Basel, Switzerland

[21] Appl. No.: 277,446

[22] Filed: Jun. 25, 1981

[30] Foreign Application Priority Data

Jun. 26, 1980 [GB] United Kingdom ..... 8020924

[51] Int. Cl.[3] ..... B66C 1/18

[52] U.S. Cl. ..... 294/74; 150/1

[58] Field of Search ..... 294/67 D, 67 E, 74, 294/77, 149–157; 150/1, 11, 12, 52 R, 52 F; 206/527, 386, 595–600

[56] References Cited

U.S. PATENT DOCUMENTS

| | | | |
|---|---|---|---|
| 2,687,321 | 8/1954 | Toffolon | 294/74 |
| 2,740,445 | 4/1956 | Fornell | 150/1 |
| 3,011,820 | 12/1961 | Frieder et al. | 294/77 |
| 3,563,433 | 2/1971 | Yoshiura | 294/157 |

FOREIGN PATENT DOCUMENTS

| | | | |
|---|---|---|---|
| 1812990 | 5/1970 | Fed. Rep. of Germany | 294/74 |
| 2634975 | 2/1978 | Fed. Rep. of Germany . | |
| 2376815 | 8/1978 | France | 50/1 |
| 188188 | 3/1964 | Sweden | 294/77 |
| 212624 | 5/1967 | Sweden | 294/77 |

*Primary Examiner*—Johnny D. Cherry

*Attorney, Agent, or Firm*—Sughrue, Mion, Zinn, Macpeak, and Seas

[57] ABSTRACT

A lifting assembly comprises a cloverleaf lifting sling in combination with a base of weldable plastics sheet material, the base having welds serving to hold the sling in its cloverleaf configuration.

10 Claims, 8 Drawing Figures

LIFTING ASSEMBLY

This invention relates to a lifting assembly including a cloverleaf sling of the type shown in FIG. 1. If a sling of this type is laid on a surface, a load such as a crate or a pile of sacks can be arranged on it and the four loops lifted to allow engagement thereof by lifting means such as the forks of a fork lift truck. The upper portions of the loop may be connected together, as by a separate tie member attached to the sling so as to fasten them around, and secure the load. A load ready to be lifted in this way (but without a separate tie member) is shown in FIG. 2.

A known cloverleaf sling is made of webbing and is secured to the FIG. 1 configuration by sewing at the four cross-over points. This sling has the disadvantage that sewing is costly and slow, and the slings have not found as wide an acceptance as they could have in certain markets.

A first object of the invention, therefore, is to provide an improved lifting assembly including a cloverleaf sling.

Accordingly, as a first aspect of the invention there is provided a lifting assembly comprising a cloverleaf lifting sling in combination with a base of weldable plastics sheet material, the base having welds serving to hold the sling in its cloverleaf configuration.

The base can be a single sheet having flaps turned-over to form pockets for the sling and welded. Preferably, however, the base comprises a pair of sheets, the two being welded together to hold the sling in its configuration.

The main advantage of cloverleaf slings is that they may be considerably cheaper than pallets and may greatly reduce handling costs, especially when goods have to be transported by sea. When used, cloverleaf slings are arranged about loads of goods as they are stacked at an end of, say, a production line or a goods entry to a warehouse. To this end the sling is laid on top of a pallet, the load stacked on top of the sling and pallet and the sling secured to the load. Whilst the load remains in the warehouse it is transported normally on the pallet. When it leaves, however, the load is lifted by the sling and the pallet remains in the warehouse. This can mean considerable saving, because a sling can cost as little as 20% of the cost of a pallet and the number of pallets needed by an organisation can be greatly reduced.

A disadvantage of such slings, however, is that during the formation of the load or stack, the four loops lie about on the floor, and thus they can obstruct work, be a danger to workers in causing falls by tripping and can impede, or be caught by or damaged by passing vehicles such as fork lift trucks.

The same problem has restricted the use of cloverleaf slings in automatic palletizing and wrapping machines. In a palletizing machine successive pallets are removed from a stack and loaded. If the load requires to be wrapped the loaded pallets are conveyed along a conveying track to a suitable wrapping machine. A sling may be laid on a pallet prior to stacking in the palletizing machine. The four loops must be stowed away by hand to avoid interfering with the palletizing and wrapping operations. It has been proposed to wind the loops around respective corner blocks of the pallet. Alternatively, it has been suggested to lay the loops in rebates at the edges of specially adapted or constructed pallets.

Both methods are inconvenient and labour intensive thus increasing the expense of the loading operation. In the latter method the special pallets give rise to further costs.

A second object of the invention therefore, is to provide a lifting assembly which obviates or mitigates these disadvantages.

Accordingly the invention provides a lifting assembly in the form of a cloverleaf sling in combination with a base of plastics sheet material, the sheet material being welded to secure the sling in its cloverleaf configuration, means being provided wherein the loop portions of the sling can be stored before deployment. Said means can be in the form of formations on the periphery of the base.

With the loop portions stored away, the assembly preferably overlaps the front and back edges of the pallet and functions as a cover on the pallet. No obstruction of load-building can occur and loops cannot be damaged or caught by passing vehicles. When the lifting assembly is required to be used, the loops are deployed and used in the normal way. Automatic palletizing and wrapping is facilitated because the assembly can be positioned easily and quickly on each pallet without the need for subsequently stowing the loop portions.

Preferably the sling has an outer coating of weldable plastics material and is secured to the base by welding.

The formtions are advantageously in the form of pockets or sleeves extending along each edge of the base.

The base can be a single sheet, the formations being formed by folding over edge portions of the sheet.

Alternatively, the base can be a pair of superposed sheets welded together and optionally to the sling, the formations being formed between edge portions thereof.

The invention will be described further, by way of example, with reference to the accompanying drawings, wherein.

Figure 1:
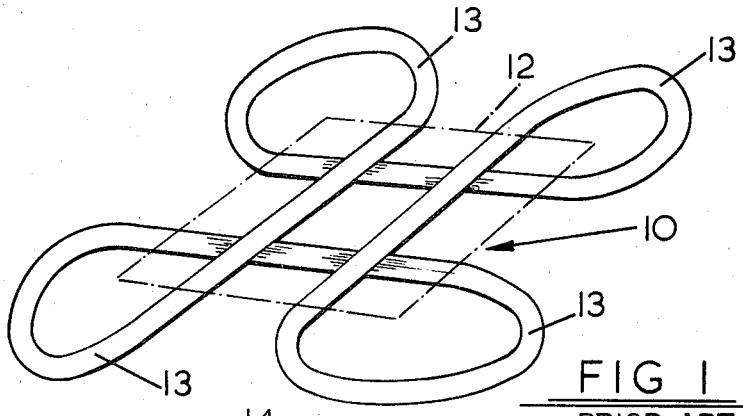
FIG 1 PRIOR ART
FIG. 1 is a perspective view of a cloverleaf sling.
Figure 2:
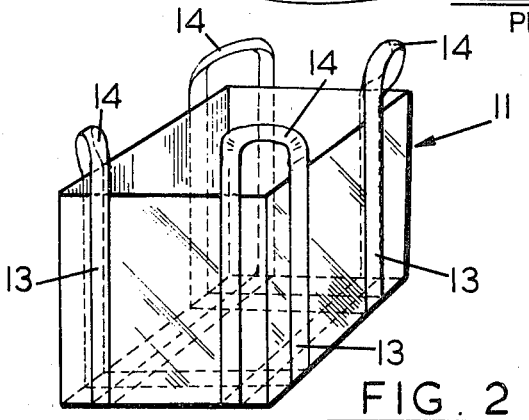
FIG. 2 PRIOR ART
FIG. 2 is a perspective view of a load ready to the lifted by such a sling.

FIG. 1 shows a cloverleaf sling 10. The sling 10 comprises a closed loop of material some 18 m long and about 6 to 8 cm wide. The sling 10 may be of webbing, in which case the ends will be sewn together. Alternatively and preferably, the sling 10 is an endless loop of strong tape-like material. In use a load 11 (FIG. 2) such as a crate or a pile of sacks, is placed on the area 12 indicated in dotted lines in FIG. 1 and the four corner loops 13 lifted up and secured to each other and to the load by straps or integral tie-loops (not shown) provided on the sling 10. The sling 10 now presents four upper lifting points 14 which can be engaged by forks of a fork lift truck or hooks of a crane or the like.

Figure 3:
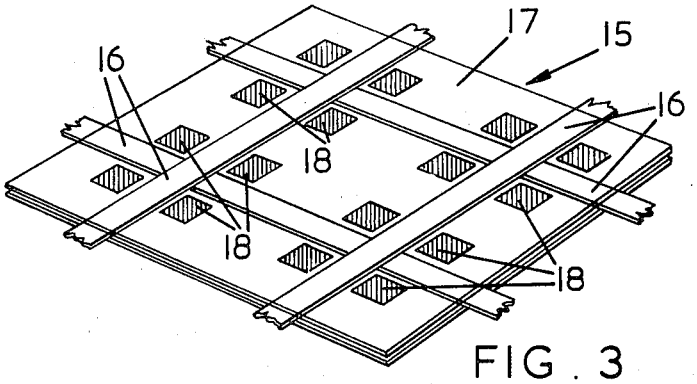
FIG. 3 is a perspective view of a central portion of a first lifting assembly of the invention.

FIG. 3 illustrates a central portion of a first preferred embodiment of lifting assembly 15 of the invention. The assembly 15 includes a cloverleaf sling 16, the corner loops of which have not been fully illustrated, similar to sling 10, and made from a length of webbing whose ends have been sewn together. The central area of the assembly has a base 17 in the form of two sheets of polyethylene which sandwich the sling 15 and are welded at sixteen areas 18 indicated by cross-hatching to hold the central area of the sling 15 in its desired configuration. The base 17 is cheap in itself and easily welded. The provision of and welding of base 17 is cheaper and quicker than the sewing of the cross-over points of sling 15 which is itself relatively cheap. A staple at each cross-over point fastens the two lengths of webbing together so as to prevent relative sliding movement thereof.

Figure 4:
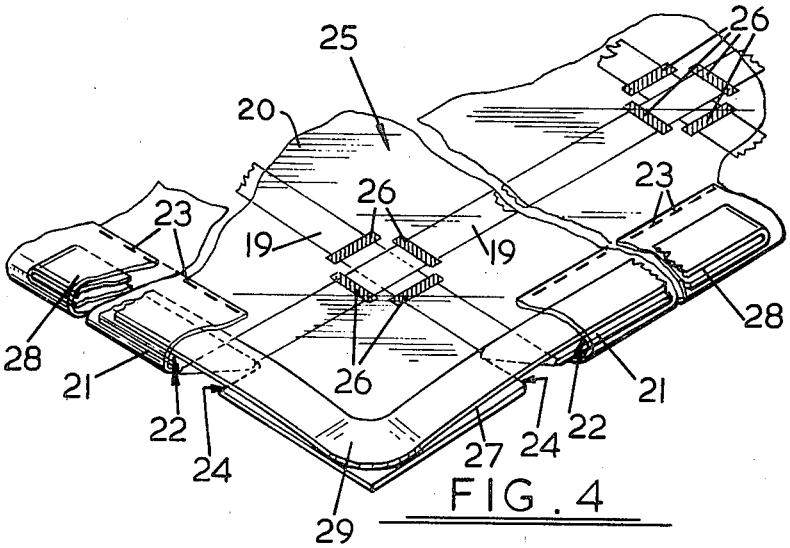
FIG. 4 is a perspective view of one corner of a second lifting assembly of the invention.

FIG. 4 shows one corner portion of a second preferred embodiment of lifting assembly 25 of the invention. The assembly 25 has a cloverleaf sling 19 similar to sling 10 but having at least an outer coating of weldable plastics material. A base 20 of polyethylene sheet overlies the central portion of the sling 19 and has flaps 21 along each edge which are folded over to form sleeves or pockets 22. Each pocket 22 has two open ends and the edge of each flap 21 is welded, stapled, sewn or otherwise secured to the body of the base 20 as indicated at 23. At each end of each pocket 22 the base 20 has a triangular cut-out 24.

Figure 6:
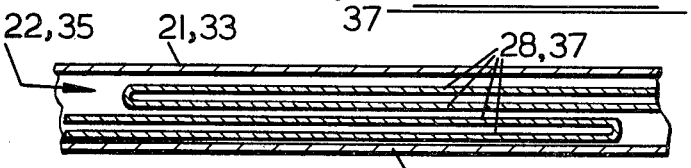
FIG. 6 is an enlarged fragmentary cross-sectional view illustrating one sling loop retaining formation of the assembly of FIG. 4 or 6.

In making the lifting assembly 25 the sling 19 is laid in its cloverleaf configuration on top of base 20 and its four cross-over points are heat welded to the base 20 by respective sets of four weld areas indicated at 26. Each corner loop 27 is then folded to have left and right doubled-over flat portions 28 (which are laid along the edges of base 20) interconnected by a centre portion 29 which lies generally on the corner portion of base 20. Each flap 21 is then folded to enclose the two portions 28, and secured at 23 to form the pockets 22. Thus each pocket 22 contains a loop portion from two corner loops 27 as is best seen in FIG. 6. As an alternative the pockets 22 can be formed first and the loop portions 28 subsequently introduced into them.

The assembly 25 is very convenient to package store and use, because the corner loops 27 are held captive in the pockets and cannot easily be deployed accidentally to be damaged or cause an obstruction or hazard. When used, the loops 27 are safely stored until needed for use when they can easily be withdrawn by pulling portions 29.

Figure 5:
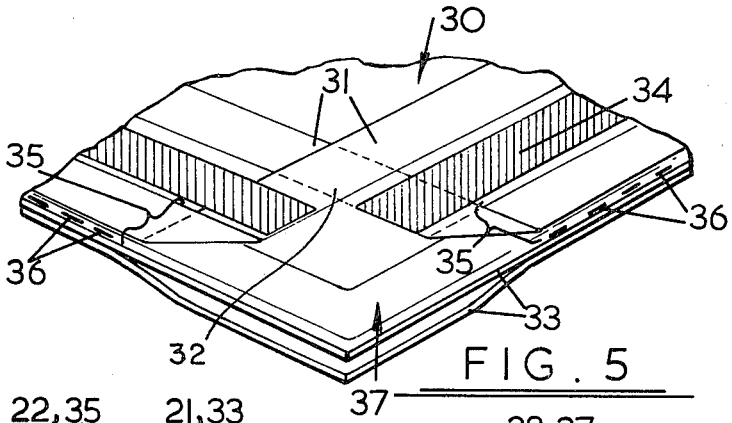
FIG. 5 is a view similar to that of FIG. 4 but showing a third embodiment of assembly of the invention.

FIG. 5 is a perspective fragmentary view showing one corner portion of a third preferred embodiment of lifting assembly 30 of the invention. The assembly 30 comprises a cloverleaf sling 31 similar to sling 19 and having four cross-over points 32 of which only one is shown. The assembly 30 has a base in the form of two sheets 33 of polyethylene which sandwich the central portion of the sling 31 and are welded together at four areas 34 which serve first to weld the sheets 33 to sling 31 and second to define inner edges of pockets 35 along central portions of the four edges of the base. At their edges along these portions the sheets 33 are secured together at 36 as by welding, stapling, or the like to define double-open-ended pockets 35 similar to pockets 22. In a manner similar to that described in the embodiment of FIG. 4 the corner loops 37 of the sling 31 are disposed with a part thereof in each adjacent pocket 22.

Assembly 30 has the same advantages as assembly 25 and is easier to manufacture, because sheets 33 do not have to be cut or folded.

FIG. 6 shows how pockets 22, 35 each accommodate a folded-over portion of each of two adjacent corner loops 27, 37.

Figure 7:
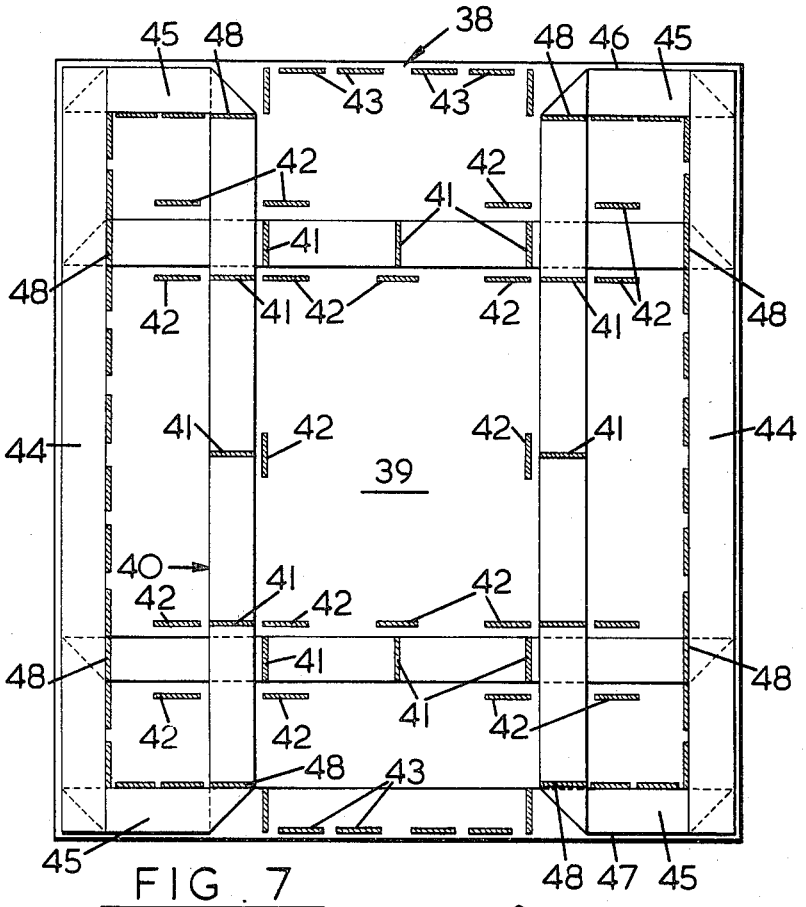
FIG. 7 is a top plan view of a fourth embodiment of lifting assembly according to the invention.
Figure 8:
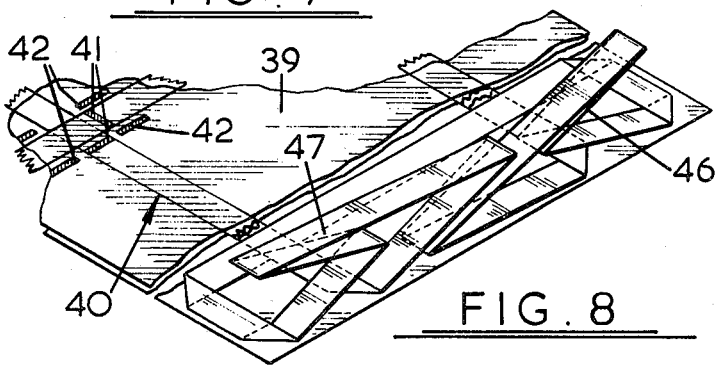
FIG. 8 is a fragmentary view of one edge of the embodiment of FIG. 7 illustrating the way in which the loops are folded.

FIGS. 7 and 8 show a fourth preferred embodiment of lifting assembly 38 having a base in the form of two sheets 39 of polyethylene which sandwich the central portion of the sling 40. As in previously described embodiments the sling 40 has at least an outer coating of weldable plastics material. The sheets 39 are welded together and to the sling 40 by bar welds indicated by hatching in FIG. 7. The top sheet 39 is welded to the sling 40 by three welds 41 on each section of the square central portion of the sling. The stability of this central portion of the sling is further ensured by welds 42 uniting the two sheets 39. Additionally, welds 43 are provided at or adjacent the periphery of the base so as to unite the sheets 39 thereby forming two long sleeves 44 extending the full length of the left and right-hand edges of the base and two short sleeves 45 extending along each of the other edges and connecting with the long sleeves 44. Since the accommodation of the loop portions of the sling within these sleeves is achieved in the same way at the left and right-hand side of the base of FIG. 7 the subsequent description will be confined to the loop portions 46, 47 at the right-hand side of the base.

The ends of the loop portions 46, 47 are fixed to the top sheet 39 of the base by peripheral welds 48 which are in line with the adjacent welds 43. As best seen in FIG. 8, the two loop portions are laid in folded overlapping relationship in the right-hand sleeve 44. The short connecting sleeves 45 receive only the minimum length of each loop portion extending between the respective weld 48 and the long sleeve 44.

The lifting assembly is made by arranging the cloverleaf sling 40 on the bottom sheet 39 of the base and then covering the sling 40 with the congruent top sheet 39. At this stage the loop portions of the sling extend from the four corners of the base but the position of the sling relative to the base may be temporarily fixed as by stapling at the cross-over points and the inner ends of the loop portions. Welding then takes place with all the welds shown in FIG. 7 being produced simultaneously. The sleeves 44, 45 are thus defined by the peripheral welds 43, the outer edges of the sleeves remaining open. The loop portions at opposite ends of each long sleeve 44 are then folded into the respective sleeve 44 in a manner which enables the outer edges of the sleeve to be progressively closed in any convenient manner as by stapling.

When the loop portions have been stowed in the sleeves the lifting assembly can be handled without fear of the loop portions escaping and causing problems of entanglement. It is a quick and simple opertion to place a lifting assembly on a pallet for use in a palletizing and wrapping line. The dimensions of the lifting assembly are such that the long sleeves 44 at the left and right-hand edges in FIG. 7 overlap the corresponding edges of the pallet so as to avoid the loop portions of the sling contained within these sleeves being trapped between the pallet and the load. The other pair of edges of the lifting assembly including the short sleeves 45 preferably coincide with the respective edges of the pallet but there is no risk of trapping of the short loop portions contained in the sleeves 45 because they will easily be pulled free by the remainder of the loop portions withdrawn from the long sleeves 44. The orientation of the lifting assembly with respect to the pallet is such that the long sleeves 44 overlap the front and back edges of the pallet as considered in the direction of its conveyance along the palletizing and wrapping line. The side edges of the pallet may then serve to guide the pallet along its conveying path without interference from overlapping parts of the lifting assembly.

The lifting assembly 38 is thus easily positioned on a pallet and unobtrusive while the load is handled by its pallet. At some stage during its transport to the eventual consumer it will be more convenient to handle the load by means of a cloverleaf sling. This stage may be as early as when the load leaves the factory or warehouse or later as for example when the load is to be lifted from the dockside into the hold of a ship. At this stage the long sleeves 44 are broken open and the loop portions pulled out and around the load into the positions shown in FIG. 2 where they are held in a manner already described. The load is now ready to be lifted by the sling, the pallet remaining behind, in the warehouse or at the dockside in the two examples given.

As described above, the welding of the base of the lifting assembly 38 takes place by means of bar welds. The welding bars are mounted on a platen in such a way that they can be located in any desired pattern or configuration on the platen appropriate to the size and shape of the lifting assembly as determined by the pallet for which it is intended.

The invention is not limited to the precise details of the foregoing and variations can be made thereto. For example, instead of being heat-welded the base sheets could be of a material having a relatively low melting point enabling them to be pressure welded together.

What is claimed is:

1. A lifting assembly, comprising: a cloverleaf lifting sling in combination with a base of plastics sheet material, said sling having a central portion and four loop portions forming a cloverleaf configuration, said base serving to hold said central portion to maintain the sling in its cloverleaf configuration, and having peripheral sleeve means for storing said loop portions of the sling.

2. An assembly as claimed in claim 1, wherein the base comprises two sheets of weldable plastics material between which said central portion of the sling is trapped by welds uniting the sheets.

3. An assembly as claimed in claim 1 wherein said base is of weldable material and has welds for holding said central portion.

4. An assembly as claimed in claim 3 or 2, wherein the sling has an outer surface of weldable plastics material and at least some of the welds unite the base with the sling.

5. An assembly as claimed in claim 4, wherein the welds define inner edges of said peripheral sleeve means.

6. An assembly as claimed in claim 5, wherein the outer edges of the peripheral sleeve means are closed to contain the loop portions.

7. An assembly as claimed in claim 6, wherein the peripheral sleeve means comprises sleeves extending along two opposed edges of the base, and each sleeve receives two loop portions extending from opposite ends of the sleeve and overlapping each other.

8. An assembly as claimed in claim 1, wherein the base is a single sheet having flaps turned-over to form said sleeve means.

9. A lifting assembly comprising: a cloverleaf lifting sling in combination with a base of weldable plastics sheet material, said sling having a central portion and four loop portions forming a cloverleaf configuration; said base having welds serving to maintain the sling in its cloverleaf configuration and having peripheral sleeve formations for receiving said loop portions; the sling having an outer surface of weldable plastics material, and at least some of the welds uniting said base with the sling; the welds defining inner edges of said peripheral sleeve formations; the outer edges of said peripheral formations being closed to contain said loop portions; and said peripheral formations extending along two opposed edges of said base, each such formation receiving two loop portions extending from opposite ends of the formation and overlapping each other.

10. An assembly as claimed in claim 9 wherein said base comprises two sheets of weldable plastics material between which said central portion of the sling is trapped by welds uniting the sheets.

* * * * *